US005784719A

United States Patent [19]

Robinson

[11] Patent Number: 5,784,719

[45] Date of Patent: Jul. 28, 1998

[54] JACKET WITH REAR COMPARTMENT

[76] Inventor: Laurie-Anne Robinson, 2804 Majestic Ct., Troy, Mich. 48083

[21] Appl. No.: 844,753

[22] Filed: Apr. 21, 1997

[51] Int. Cl.[6] ..... A41D 1/02

[52] U.S. Cl. ..... 2/94; 2/93

[58] Field of Search ..... 2/93, 94

[56] References Cited

U.S. PATENT DOCUMENTS

| | | | |
|---|---|---|---|
| 2,620,479 | 12/1952 | Buck | 2/94 |
| 2,970,316 | 2/1961 | Silin | 2/94 |
| 4,068,314 | 1/1978 | Yellen et al. | 2/94 |
| 4,389,735 | 6/1983 | McLaughlin | 2/94 |
| 4,502,155 | 3/1985 | Itoi | 2/94 X |
| 4,563,777 | 1/1986 | Park | 2/94 X |
| 4,689,831 | 9/1987 | Greenberger et al. | 2/94 X |
| 4,700,409 | 10/1987 | DeLott | 2/94 |
| 4,949,401 | 8/1990 | Kimsey | 2/94 X |
| 5,123,117 | 6/1992 | Prendergast | 2/94 X |
| 5,165,111 | 11/1992 | Lieberman | 2/94 |

FOREIGN PATENT DOCUMENTS

| | | | |
|---|---|---|---|
| 1561459 | 2/1980 | United Kingdom | 2/94 |

*Primary Examiner*—C. D. Crowder
*Assistant Examiner*—Shirra L. Jenkins
*Attorney, Agent, or Firm*—The Chupa Law Firm

[57] ABSTRACT

A jacket having a large storage compartment located in the upper central region of the rear of the jacket. In one embodiment of the invention, jacket 2 comprises a torso portion 8 having a large storage compartment 36 located in the upper central region of the back or rear side of torso portion 8 and having a flap 38 which can be moved from a "closed" position in which the contents of storage compartment 36 are covered and/or protected, to an "open" position in which items can be placed into or removed from storage compartment 36.

1 Claim, 3 Drawing Sheets

JACKET WITH REAR COMPARTMENT

1. FIELD OF THE INVENTION

The present invention relates to a jacket having a large compartment attached to the rear of the jacket, and, more particularly, in one embodiment, to a jacket including weather-proof outer shell having an expandable storage compartment sewn into the rear of the outer shell.

2. BACKGROUND OF THE INVENTION

Jackets are generally designed to protect a wearer from a variety of temperatures and/or weather conditions. Jackets may be designed to be worn indoors, outdoors or a combination of both. Many outdoor jackets of the prior art include a weather-proof outer shell manufactured from a material such as, and without limitation, nylon or canvas, and an inner lining manufactured from an insulating material such as, and without limitation, fleece or wool. In many prior jackets, the lining is sewn into, or otherwise permanently attached, to the outer shell of the jacket.

In another type of prior outdoor jacket, the inner lining is removably attached to the outer shell by attachments such as, and without limitation, zippers or buttons. These attachments can be conveniently and relatively quickly operated to remove and attach the inner lining from the outer shell of the jacket. Such jackets are designed so that a wearer will be able continue to utilize the jacket in a variety of temperatures. That is, in warmer temperatures the wearer can quickly and easily remove the inner lining and wear only the light, weather-proof outer shell. If temperatures become colder the wearer can re-attach the inner lining and wear it in combination with the outer shell.

In contrast to aforedescribed prior outdoor jackets, prior indoor jackets generally lack a "weather-proof" outer shell and are instead typically manufactured from materials such as wool, cotton, velvet, etc.. While some prior indoor jackets have an inner lining, the lining is typically designed for style and/or comfort rather than insulation and is typically manufactured from a thin material or fabric such as, and without limitation, polyester, cotton silk, etc..

All of the jackets of the prior art suffer from a lack of storage space. Most jackets have a few storage compartments or "pockets" located in the front of the jackets and some jackets have an additional pocket or pockets located within the inner lining of the jackets. These storage compartments or "pockets" provide storage space for small items such as keys, a wallet, coins, and/or other small paraphernalia. The pockets present in outdoor jackets of the prior art, however, do not provide a wearer with enough space to store larger items such as folders, books, daily planners, food items, etc.. Furthermore, such pockets are also not sturdy enough to carry heavier and/or larger items and can be subject to tearing and/or ripping when such items are carried. Moreover, the location of the pockets/storage compartments (e.g. in the front of the jacket) makes it difficult to carry large and/or heavy items, whose weight and/or volume would be more efficiently distributed and less encumbering to the wear if they were located on or about the upper central portion of the wearer's back. Due to these structural limitations and lack of storage space, persons wearing jackets of the prior art generally need to carry additional storage containers such as back packs, purses, bags, brief cases, etc., to safely transport larger and/or heavier items. The necessity of carrying additional storage containers creates problems for the jacket wearer, especially if the wearer is a child or young adult.

Children and young adults often are required to carry additional storage containers. Specifically, children and young adults who are in school are required to carry large items such as books, lunches, notebooks, calculators, planners, etc., on a daily basis. Such large items do not fit in, and if placed in can cause damage to, the limited storage compartments (or pockets) of the jackets of the prior art. Thus, many children and young adults opt to carry a storage container, such as a back pack, in order to secure and transport these larger items on a daily basis. While the practice of wearing a back pack in combination with a jacket can allow a wearer to efficiently distribute the weight and volume of the items carried in an non-encumbering manner, several drawbacks exist to this practice.

One drawback related to carrying a back pack is that, in the course of a typical day, the child, or young adult, is required to remove the back pack many times, and many children often "leave behind" or lose the back pack and/or its contents. Another drawback related to carrying a back pack is that, in order to fit and secure the back pack on a child, the straps must often be held or adjusted by the child, depending on the amount of items in the back pack and/or the particular jacket, or other outerwear being worn by the child. Furthermore, many children, especially young children, have difficulty putting on back packs while wearing "bulky" winter clothing and/or jackets.

Another drawback to carrying a back pack which is common to children and active adults is that the back pack will bounce, move, and/or even fall off a wearer who is engaged in physical activity such as jogging, running, jumping and/or sports. In order to prevent this occurrence, the wearer often has to frequently hold, loosen and/or tighten the backpack by its straps. These frequent "adjustments" undertaken by the wearer, prevent the wearer from using his or her hands for other purposes, and can be ultimately unsuccessful in eliminating undesired "bouncing" and/or movement of the back pack. Adults and children who choose to carry storage containers such as a purse, brief case or duffel bag encounter similar restrictions, since a user to must typically hold and/or secure the storage container with his or her arms and/or hands at all times.

There is therefore a need to provide a jacket that overcomes some or all of the difficulties of the prior art and that can be worn in a variety of temperatures and weather conditions; that includes a large storage compartment in the rear of the jacket; that eliminates the need for a wearer to carry an additional storage container such as a back pack; that is reinforced and strong enough to secure large and heavy items; allows the wearer constant and free use of his or her hands, and that is convenient and easy to use.

SUMMARY OF THE INVENTION

It is therefore a primary object of this invention to provide a jacket that can be worn in a variety of temperatures and weather condition and that has a large storage compartment sewn into the rear portion of the jacket.

It is another object of this invention to provide a jacket that has a large, reinforced storage area located in the rear portion of the jacket which is large and strong enough to secure and transport large and heavy items.

One embodiment of the invention comprises: a torso portion having a right front side, a left front side, and a rear side, said rear side having an upper central region; a fastener attached to said right front side and said left front side of said torso portion and operative to connect and disconnect said right front side and said left front side, thereby opening and closing said torso portion; and a relatively large storage compartment permanently affixed to said upper central region of said rear side of said torso portion, and in which items may be placed and carried.

Further objects, features, and advantages of the present invention will become apparent from any consideration of the following description and the appended claims, when taken in conjunction with the accompanying drawings.

BRIEF DESCRIPTION OF THE DRAWINGS

For a fuller and more complete understanding of the nature and objects of the present invention, reference should be had to the following drawings in which.

DETAILED DESCRIPTION OF THE INVENTION

Figure 1:
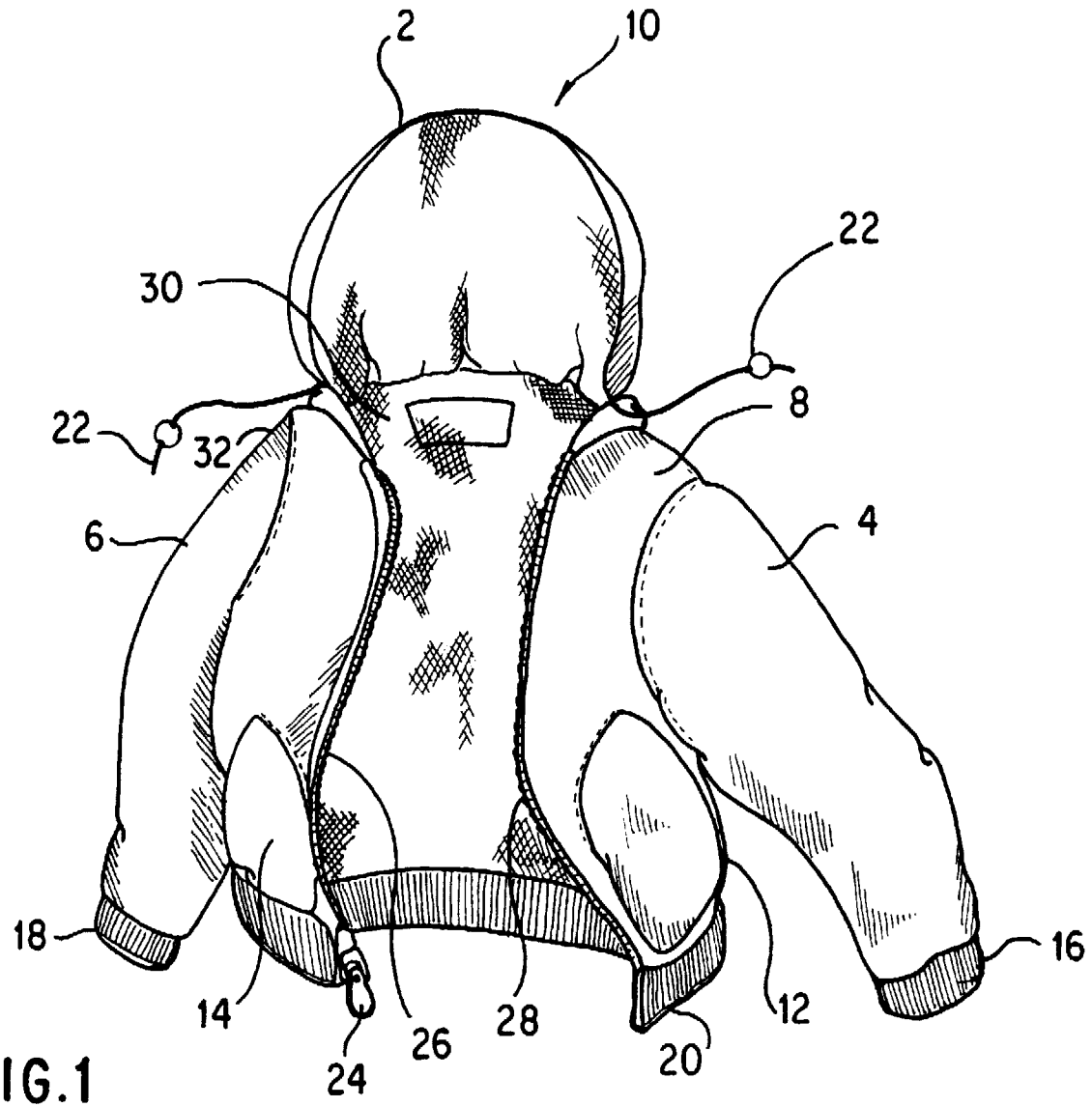
FIG. 1 is a front view of a jacket made in accordance with the teachings of the preferred embodiment of the present invention.

Referring now to FIG. 1, there is shown a front view of a jacket 2 made in accordance with the preferred embodiment of this invention. As shown, jacket 2 comprises a torso portion 8 and sleeves 4 and 6 which are permanently attached to torso portion 8 by a conventional and commercially available method and material, such as and without limitation machine sewing using a durable fiber or thread. In the preferred embodiment of the invention, jacket 2 comprises an outer shell 32 and an inner lining 30.

Outer shell 32 is manufactured from a light, strong and weather-proof fabric such as, and without limitation, nylon of treated canvas. Inner lining 30 underlies or "lines" the interior of torso portion 8 and sleeves 4 and 6. In one embodiment of jacket 2, inner lining 30 of jacket 2 can comprise a warm, insulating material or fabric such as, and without limitation, wool or fleece. In another embodiment of jacket 2, inner lining 30 can comprise two layers of a thin, durable fabric which are sewn together and filled or "stuffed" with a warm insulating material such as, and without limitation, down.

In the preferred embodiment of the invention, inner lining 30 is removably attached to outer shell 32 by a conventional and commercially available attachment method, such as by zippers or buttons. Removably attaching the inner lining to the outer shell of a jacket is common in the art and the precise design and operation of the removable attachment method should be understood by those of ordinary skill in the art. It should be further understood by one of ordinary skill in the art that the attachments used to secure inner lining 30 to outer shell 32 of jacket 2 can be conveniently and relatively quickly operated to remove and attach inner lining 30 from outer shell 32 of jacket 2. Hence, jacket 2 is designed so that a wearer may utilize jacket 2 in a variety of temperatures and weather conditions. That is, in warmer temperatures the wearer can quickly and easily remove inner lining 30 and wear only the light, weather-proof outer shell 32. If temperatures become colder the wearer can re-attach inner lining 30 and wear it in combination with outer shell 32 of jacket 2.

In another embodiment of the invention, inner lining 30 is permanently attached to outer shell 32. Inner lining 30 may be sewn into outer shell 32 using a conventional and commercially available sewing machine and a durable thread or fiber. The exact method of sewing inner lining 30 into outer shell 32 should be understood by those of ordinary skill in the art.

In the preferred embodiment of the invention, torso portion 8 of jacket 2 includes pockets 12 and 14. Pockets 12 and 14 are manufactured from the same material as outer shell 32 and are attached onto torso portion 8 using a conventional and commercially available method and material such as by using a sewing machine and a durable thread or fiber. In the preferred embodiment of the invention, pockets 12 and 14 are large enough to hold small to medium-sized items such as, and without limitation, keys, gloves, a wallet or pocketbook, etc..

The preferred embodiment of the invention further comprises a waistband 20 which is permanently attached or sewn to the lower end or "bottom" of torso portion 8. Waistband 20 is manufactured from a constricting material such as and without limitation an elastic or elastic-based material. When jacket 2 is worn, waistband 20 constricts around the wearer's waist, thereby preventing unwanted elements such as cold air and/or snow from entering through the lower end or bottom of jacket 2. In the preferred embodiment of the invention sleeves 4 and 6 include cuff portions 16 and 18 which are respectively and permanently attached or sewn to the ends of sleeves 4 and 6. Cuff portions 16 and 18 are manufactured from a constricting material substantially similar to the material of waistband 20. When jacket 2 is worn, cuff portions 16 and 18 constrict around the wearer's wrists, thereby preventing unwanted elements such as cold air and/or snow from entering into jacket 2 through the ends of sleeves 4 and 6.

In the preferred embodiment of the invention, jacket 2 can be "closed" using conventional and commercially available zipper attachments 26 and 28 which are permanently fixed to the right front side and left front side of jacket 2. Fastener 24 is used to "zip" or fasten zipper attachments 26 and 28 together, thereby "closing" jacket 2. The precise design, manufacture and operation of zipper attachments 26 and 28 should be known to one of ordinary skill in the art. Furthermore, it should be know to one of ordinary skill in the art that other attachment methods such as buttons or VELCRO® can be used in place of or in combination with a zipper to "close" and "open" jacket 2.

In the preferred embodiment of the invention, jacket 2 further comprises a hood 10 which is removably attached to the upper-most end or "top" of torso portion 8 of jacket 2 by a conventional and commercially available attachment method, such as and without limitation buttons, a zipper, or VELCRO®. Draw strings 22 reside around the front perimeter of hood 10 and are operative to constrict hood 10 around a wearer's head, thereby securing hood 10 to the wearer's head and preventing unwanted elements such as cold air, rain and/or snow from entering hood 10 and jacket 2 and/or contacting the wearer's head.

Figure 2:
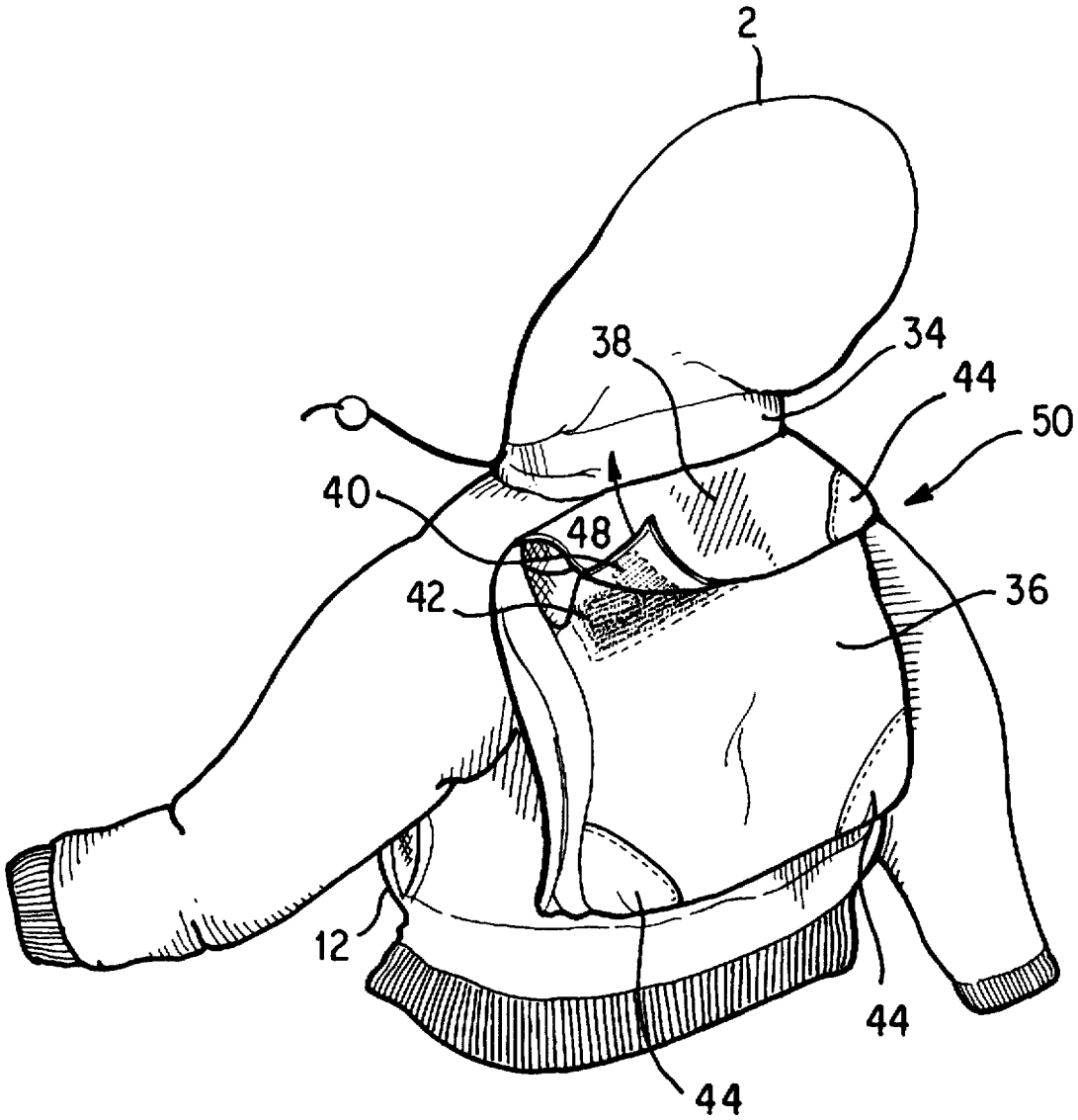
FIG. 2 is a back view of a jacket made in accordance with the teachings of the preferred embodiment of the present invention.

Referring now to FIG. 2, there is shown a back view of jacket 2. As illustrated in FIG. 2, jacket 2 further comprises a collar portion 34 which is permanently attached to the upper-most end or "top" of torso portion 8. Collar portion 34 is manufactured from material substantially identical the material of torso portion 8 and has an inner lining substantially identical to that of torso portion 8. When jacket 2 is fully "closed" or "zipped", collar portion 34 "wraps around" the wearer's neck, thereby keeping the wearer's neck protected from elements such as cold air, rain, snow, etc..

As illustrated in FIG. 2, jacket 2 further comprises a storage compartment 36 which is attached to the rear or back portion of outer shell 32. Storage compartment 36 is substantially similar in size and shape to a conventional backpack. In the preferred embodiment of the invention, storage compartment 36 is permanently attached to the rear or back portion of outer shell 32 by using a conventional and commercially available method and material such as, and without limitation, by using a sewing machine and a durable thread or fiber. Storage compartment 36 is manufactured from a durable, weather-proof material substantially identical to the material of which outer shell 32 is manufactured, thereby protecting the contents of storage compartment 36 from elements such as rain, sleet, snow, etc..

As further illustrated in FIG. 2, in the preferred embodiment of the invention, storage compartment 36 is generally rectangular in shape. Storage compartment 36 is located approximately in the upper central region of the back or rear side of torso portion 8. This location is substantially similar to the location of a typical back pack and thus results in the desired weight and volume distribution associated with a back pack (i.e. located in the upper central portion of the wearer's back). As illustrated in FIG. 2, storage compartment 36 is approximately as wide as torso portion 8 and extends from a point just below collar portion 34 to a point just above the lower end of pockets 12 and pocket 14 (not illustrated in FIG. 2).

Storage compartment 36 comprises a flap 38 and four (4) corner reinforcements 44. As illustrated in FIG. 2, one (1) corner reinforcement 44 is located on each of the two (2) lower or bottom exterior corners of storage compartment 36 and one (1) corner reinforcement is located on each of the lower or bottom corners of flap 38. Corner reinforcements 44 are manufactured from a durable material such as, and without limitation, leather, plastic, or nylon, and are permanently attached to their respective corners by a using a conventional and commercially available method such as, and without limitation, by sewing or by using an adhesive. It should be understood by one of ordinary skill in the art that the corners of storage compartment 36 are susceptible more "wear and tear" than any other exterior portion of storage compartment 36 and thus, corner reinforcements 44 protect storage compartment 36 at its most vulnerable areas.

Figure 3:
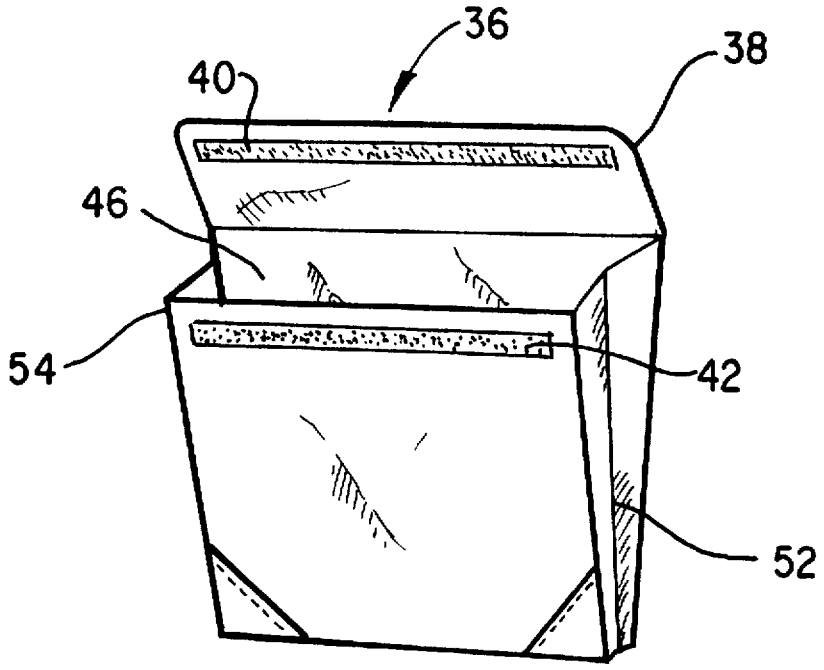
FIG. 3 is a perspective view of a storage compartment made in accordance with the teachings of the preferred embodiment of the present invention.

FIG. 3 illustrates a perspective view of storage compartment 36 made in accordance with the teachings of the preferred embodiment of the invention. In order to access storage compartment 36, flap 38 can be moved from a "closed" position, as illustrated in FIG. 2 to a "open" position as illustrated in FIG. 3. When flap 38 is "closed", fasteners 40 and 42 cooperate to hold and secure flap 38 in its "closed" position, thereby protecting the contents of storage compartment 36. As illustrated in FIGS. 2 and 3, in the preferred embodiment of the invention, fasteners 40 and 42 are VELCRO®. However, it should be understood by one of ordinary skill in the art that any conventional or commercially available fasteners could be used without departing from the spirit and scope of the invention, such as, and without limitation, zippers, buttons, buckles, plastic clips, etc.. A user can "open" storage compartment 36 by applying force to flap 38 in an upward direction as illustrated by arrow 48 in FIG. 2, thereby disengaging fasteners 40 and 42. Once fasteners 40 and 42 are disengaged, flap 38 can be raised or "lifted up", exposing opening 46 as illustrated in FIG. 3. A user may place items into and/or remove items from, storage compartment 36 through opening 46. Storage compartment 36 is large enough to hold items such as, and without limitation, school books, notebooks, planners, food items, etc.. Side portions 52 and 54 of storage compartment 36 are designed to expand as items are placed within storage compartment 36, thereby increasing the overall volume and capacity of storage container 36. Side portions 52 and 54 will contract as items are removed from storage compartment 36. In the preferred embodiment of the invention, the expansion and contraction of side portions 52 and 54 is achieved by introducing one or more folds into side portions 52 and 54 so that they will fold inward as the volume of the contents of storage compartment 36 decreases and expand outward as the volume of the contents of storage compartment 36 increases. However, the inventor realizes, as should one of ordinary skill in the art, that the expansion and contraction of side portions 52 and 54 can be similarly and properly achieved by the introduction of a constricting or elastic-type material into side portions 52 and 54.

A user can "close" storage compartment 36 by lowering flap 38, aligning fastener 40 with fastener 42 and pressing inward on flap 38 in the direction indicated by arrow 50 illustrated in FIG. 2, thereby engaging fasteners 40 and 42 and securing flap 38 in a "closed" position.

In a second embodiment of the invention, storage compartment 36 can be removably attached to jacket 2 using a conventional and commercially available attachment technique such as, and without limitation, zippers or buttons. In this second embodiment, jacket 2 may be worn with or without storage compartment 36 if the user desires.

It should be understood by one of ordinary skill in the art that jacket 2 can designed in multitude of ways, using a multitude of fabrics and materials and conforming to various fashion trends and desires without departing from the spirit and scope of the invention. For example, and without limitation, storage compartment 36 may be fixed to the upper central back region of an indoor jacket or a rain coat. It should be further understood that the descriptions and illustrations of the aforementioned embodiments in no way limit the scope of the invention. Inventor realizes, as should one of ordinary skill in the art, that various changes and modifications may be made to the invention without departing from the spirit and scope of the invention as defined in the following claims.

I claim:

1. A jacket comprising:

a torso having a top, rear, and bottom portion;

a pair of substantially identical sleeves attached to said torso;

a waistband attached to said bottom;

a hood which is removably attached to said top of said torso;

a substantially rectangular storage compartment having a plurality of reinforcement portions which are deployed at opposed ends of said storage compartment and which is removably attached to said rear of this torso proximate to said collar and only being attached to said rear of said torso at the upper central region of said rear, said storage compartment further having a generally rectangular flap portion which is moveable between a first storage compartment open position and a second storage compartment closed portion, said flap further having a plurality of reinforcement portions which cooperate with said reinforcement portions located upon said storage compartment in order to protect said storage compartment from wear damage, said to storage compartment further having opposed expandable side portions which are longitudinally coextensive to said storage compartment and which move to an expandable position to allow storage of goods in said storage compartment.

* * * * *